US010858836B2

(12) United States Patent
Adams

(10) Patent No.: US 10,858,836 B2
(45) **Date of Patent: *Dec. 8, 2020**

(54) FASCIA GUTTER SYSTEM AND COVERINGS USING THE SAME

(71) Applicant: Mike Adams, Fullerton, CA (US)

(72) Inventor: Mike Adams, Fullerton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/261,205

(22) Filed: Jan. 29, 2019

(65) Prior Publication Data

US 2020/0240147 A1 Jul. 30, 2020

(51) Int. Cl.
*E04D 13/00* (2006.01)
*E04D 13/068* (2006.01)

(52) U.S. Cl.
CPC ..... *E04D 13/068* (2013.01)

(58) Field of Classification Search
CPC ..... E04D 13/064; E04D 13/067; E04D 13/15; E04D 13/0648
USPC ..... 52/11, 12, 15, 95, 588.1, 592.1, 309.9, 52/200, 582.2, 656.1, 783.1, 800.1, 802.1; 248/48.1, 48.2; 210/474
See application file for complete search history.

(56) References Cited

U.S. PATENT DOCUMENTS

| | | | | |
|---|---|---|---|---|
| 8,590,211 | B1 * | 11/2013 | Adams | E04D 13/064 52/11 |
| 8,720,121 | B2 * | 5/2014 | Adams | E04D 13/158 52/12 |
| 9,115,496 | B2 * | 8/2015 | Adams | E04D 13/158 |
| 9,683,370 | B2 * | 6/2017 | Adams | E04D 13/158 |
| 9,926,705 | B2 * | 3/2018 | Adams | E04D 13/158 |
| 10,190,317 | B2 * | 1/2019 | Adams | E04D 13/158 |

* cited by examiner

*Primary Examiner* — Chi Q Nguyen
(74) *Attorney, Agent, or Firm* — The Law Office of Austin Bonderer, PC; Austin Bonderer

(57) ABSTRACT

A covering employing a fascia gutter is disclosed. The fascia gutter includes a front member, bottom member, a rear member, a ledge, a guiding groove, a protrusion and a receiving space. The bottom member connects the front member to the rear member. The receiving space is defined by the front member, the bottom member, and the rear member. The ledge is connected to the rear member. An opening is defined by the ledge and the protrusion.

17 Claims, 16 Drawing Sheets

FASCIA GUTTER SYSTEM AND COVERINGS USING THE SAME

BACKGROUND OF THE INVENTION

The invention relates to systems used to construct coverings. The systems include flat pan and insulated panels that interlock with one another along abutting edges. These two systems tend to be heavily used the covering industry. These designs have proven to be very reliable and long lasting.

The benefits of the insulated panels are that they insulate the area that they are covering and are fairly strong. The insulated panel coverings come with interlocking panels 2. The panels 2 typically comprise of two metal layers with an insulated material located in the middle. The panels come in standard sizes (e.g. 2 feet in width and 4 inches in height) with interlocking components. This system has a long working life and comes with the industry standard of a 20 year warranty.

As can be seen in FIGS. 17 and 18, in order to collect rainwater, a gutter 160 is present along the lower end of the sloped covering. Water will run off the top of the joined insulated panels 2 and collect in the gutter 160. The water is then guided away. This system works as long as the integrity of the joints 9 is maintained.

The gutter 160 is level or just below level with the top surface of the insulated panels 2. The gutter 160 is a truncated U-shaped with the shorter solid part being the gutter face 161. The gutter face 161 abuts the face of the insulated panels 2. The taller end is the gutter front 162 and is used so that water does not escape over the edge of the gutter 160 as it runs swiftly down the very smooth covering. Typically, since these gutters 160 are so unsightly, a wrapping kit 170 is employed. The gutter face 161 serves as an end cap and seal the joints 9, ducts 95 and channels 91. During construction, a seal is applied so that the panel 2 and the wrapping kit are sealed to the gutter 160. Once water is located in the ducts 95 and/or channels 91, the gutter face 161 prevents the water from escaping.

The wrapping kit 170 also adds another layer of materials onto the exterior of the covering. The wrapping kit 170 adds weight and cost to the covering. Additionally, it adds more points that must be properly sealed. The wrapping kit 170 increases the areas in which the integrity of the covering may fail.

Joints 9 are the weakest part of the system. Many times only an external seal 96 is applied to the joint. Other times, internal seals 92 are also applied. Both the external seals 96 and the internal seals 92 will typically deteriorate before the panels 2 will. The interlocking joints 9 have several designs, but work on the same basic principle. U.S. Pat. No. 5,216,861 to Meyerson and U.S. Pat. No. 5,502,939 to Zadok et al. discloses designs that has an interlocking system with sealant pockets within the joint 9. As can be seen in FIG. 9, the seals will create channels 91. The internal seals 92 will be applied during, or before, the construction process as well as the external seal 96. This will help elongate the life of the covering by limiting exposure to the sun to the internal seals 92. Thus when the external seal 96 fails; there are several internal seals 92 that will extend the life of the covering. As mentioned before, these internal seals 92 create channels 91 that run along the length of the joint 9 and terminate at the gutter face 161. As such, the water within the joint has no means to escape, except through the entrance in which it came. In other insulated panels, only one seal is present and is applied along the uppermost junction of the joint 9, the external seal 96. In these panels, water tends to accumulate in the duct 95. Water can also collect in the ducts 95 when internal seals 92 are present.

However, the elements are not kind to these internal seals 92. Eventually the rain and exposure will deteriorate all the internal seals 92. This is partly because water will enter from the top and accumulate in these channels 91, once the external seal 96 is breached. Due to weather, the properties of water and biological growth, these internal seals 92 will deteriorate. Water will accumulate in the duct 95 when the inner seals are or are not present. Once water fills the duct 95 it will overflow and water will flow past the duct 95. As illustrated by FIGS. 9, 10, 17 and 18, water will also tend to fill the channels 91 as there is no means for the water in the channels 91 to escape, due to the gutter face 161 of the gutter 160. Once the bottom most internal seal 92 fails, if present, the covering now has a leak. If there is no seal between the duct and the bottom of the panel 2, water will just flow out of the joint 9 once the duct 95 overflows. The standing water will decrease the effective lifespan of the entire covering. This is a major issue in the industry for as long as these insulated panels 2 have been employed. To date, there is no solution to this problem this overflow problem.

Another issue with the use of wrapping kits 170 is that they are not able to provide support for the covering. Typically coverings do not to extend too much past the boundaries of the area wished to be covered. Since the wrapping kits 170 extend the borders of the covering, the support columns must be brought further into the area to be covered so as to be properly supported. This will decrease the useful space of the area being covered.

SUMMARY OF THE INVENTION

In one embodiment, the fascia gutter 1 is employed with an insulated panel 2. By having the fascia gutter 1 running transverse to the joint 9 and open to the channels 91 (as seen in FIG. 11), the entire joint 9 is in communication with the fascia gutter 1. Thus, just like the top of the panel, water present inside the joint 9/channels 91/duct 95 will flow into the fascia gutter 1 and be removed from the joint 9. This will decrease the time that the seals 92 are exposed to water and/or time that the duct 95 holds water.

It is believed, and stands to reason, that less time these seals 92 are exposed to water, standing or otherwise, the longer they will maintain their integrity. Also if water is evacuated from the duct 95, water will not overflow the duct 95 and out the joint 9. The longer the integrity of the joint 9 is maintained, the longer the covering will last without maintenance.

When a covering system employs insulated panels, the use of the fascia gutter 1 allows the system to be built without a wrapping kit 17.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION OF THE DRAWINGS

Figure 1:
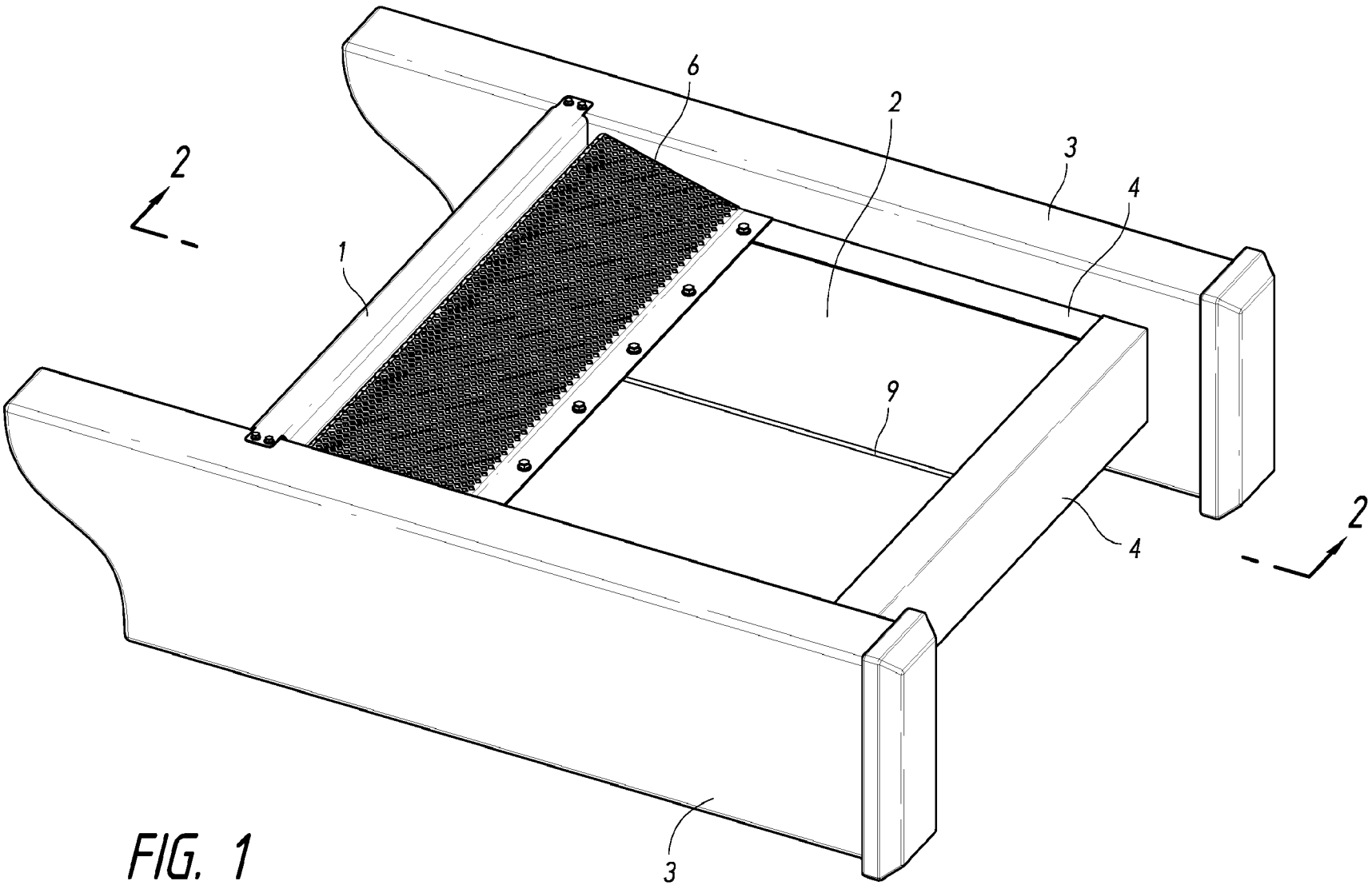
FIG. 1 shows an embodiment of a covering.
Figure 2:
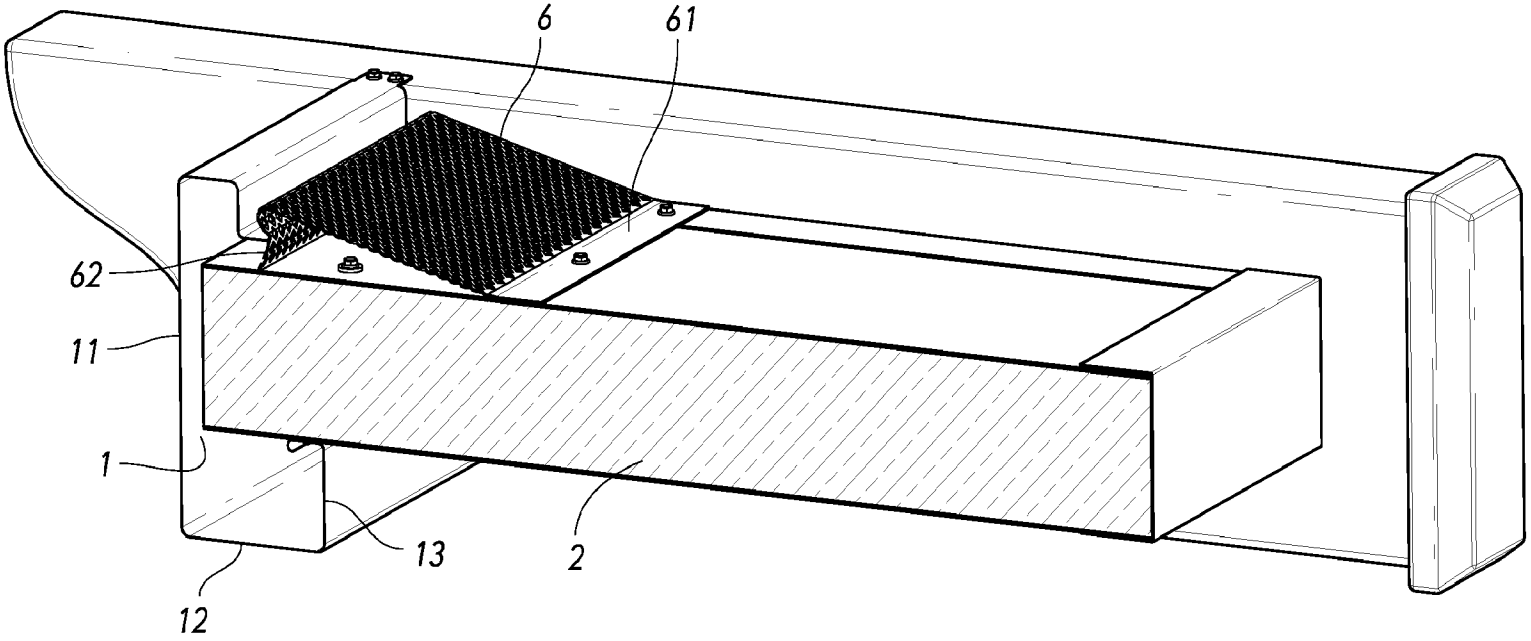
FIG. 2 shows a cross-section of an embodiment.

Referring to FIGS. 1 and 2, an embodiment with rafters 3 and insulated panels 2 is shown. There are caps 4 present on the rear and sides of the panels 2. The rafters 3 are connected to the fascia gutter 1, and the caps 4 are present on the side of the panels 2. A debris guard 6 is located near the front of the panels 2. The debris guard 6 comprises a base 61 and a screen 65. The base 61 is secured to the panels 2 and/or caps 4. The debris guard 6 increases its profile such that it is greater than the gap 7 defined by the panels 2 and the protrusion 16. In some embodiments, the base 61 is merely an extension of the screen 65. In other embodiments, the base 61 is a solid piece of material. The debris guard 6 helps prevent debris, such a leaves, from entering and thus clogging the fascia gutter 1. The rise of the debris guard 6 from the base 61 to the overhang 64 allows leaves to be easily blown away.

In one embodiment, the debris guard 6 comprises an end 62, a protrusion bend 63, and an overhang 64. The overhang 64 extends over the edge of the protrusion 16. This will help ensure that the clogging debris will not be allowed to slip around the front side of the debris guard 6. In some embodiments the overhang 64 will actually make contact with the fascia gutter 1. The end 62 of the debris guard 6 also extends past the end of the protrusion 16 as well. The protrusion bend 63 is located between the end 62 and the overhang 64. In some embodiments, the protrusion bend 63 is located at the vertex of a sharp bend or a rounded bend. The protrusion bend 63 can be in contact and abut the protrusion 16

Figure 6:
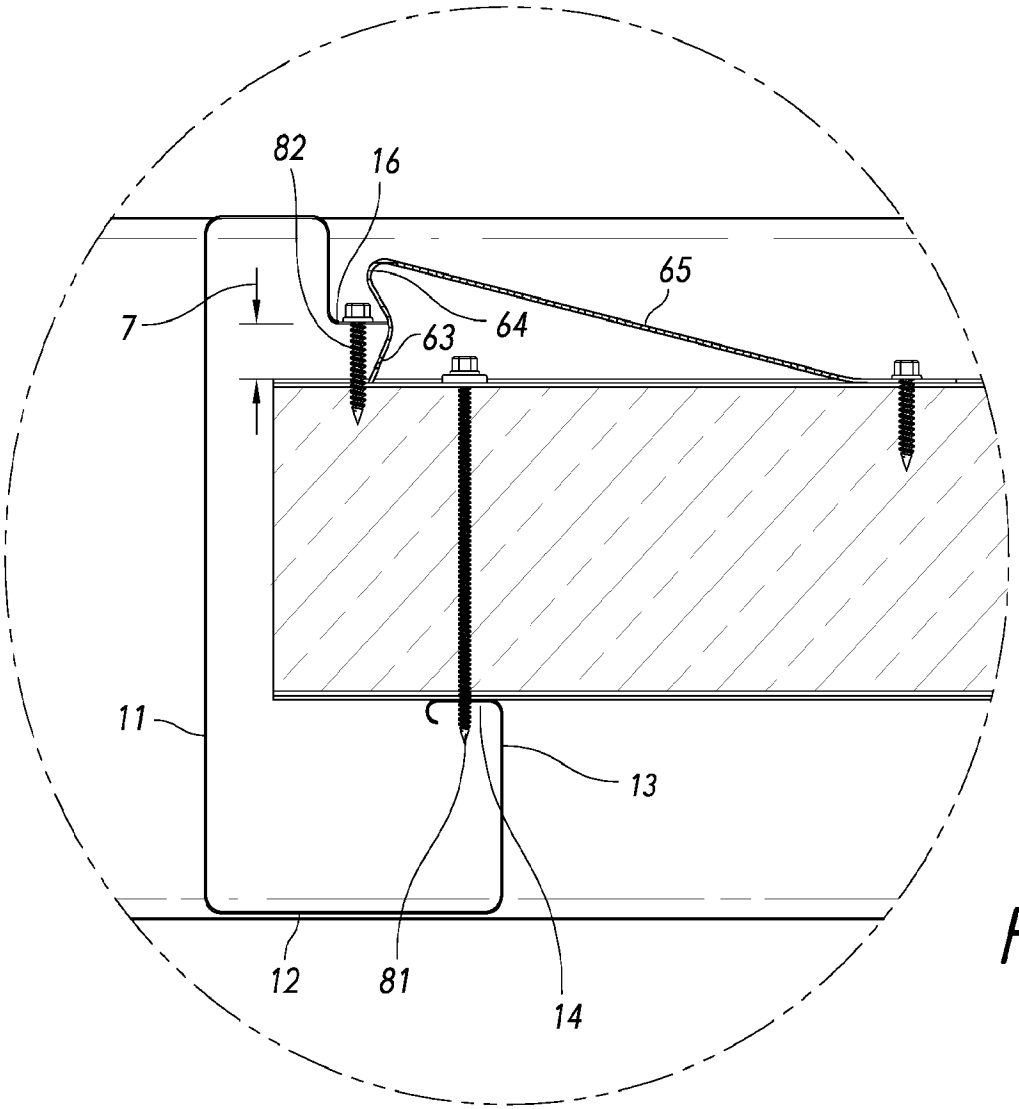
Figure 8:
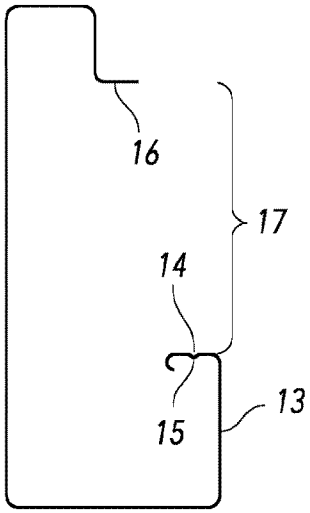
FIGS. 7 and 8 show embodiments of the fascia gutter.
Figure 7:
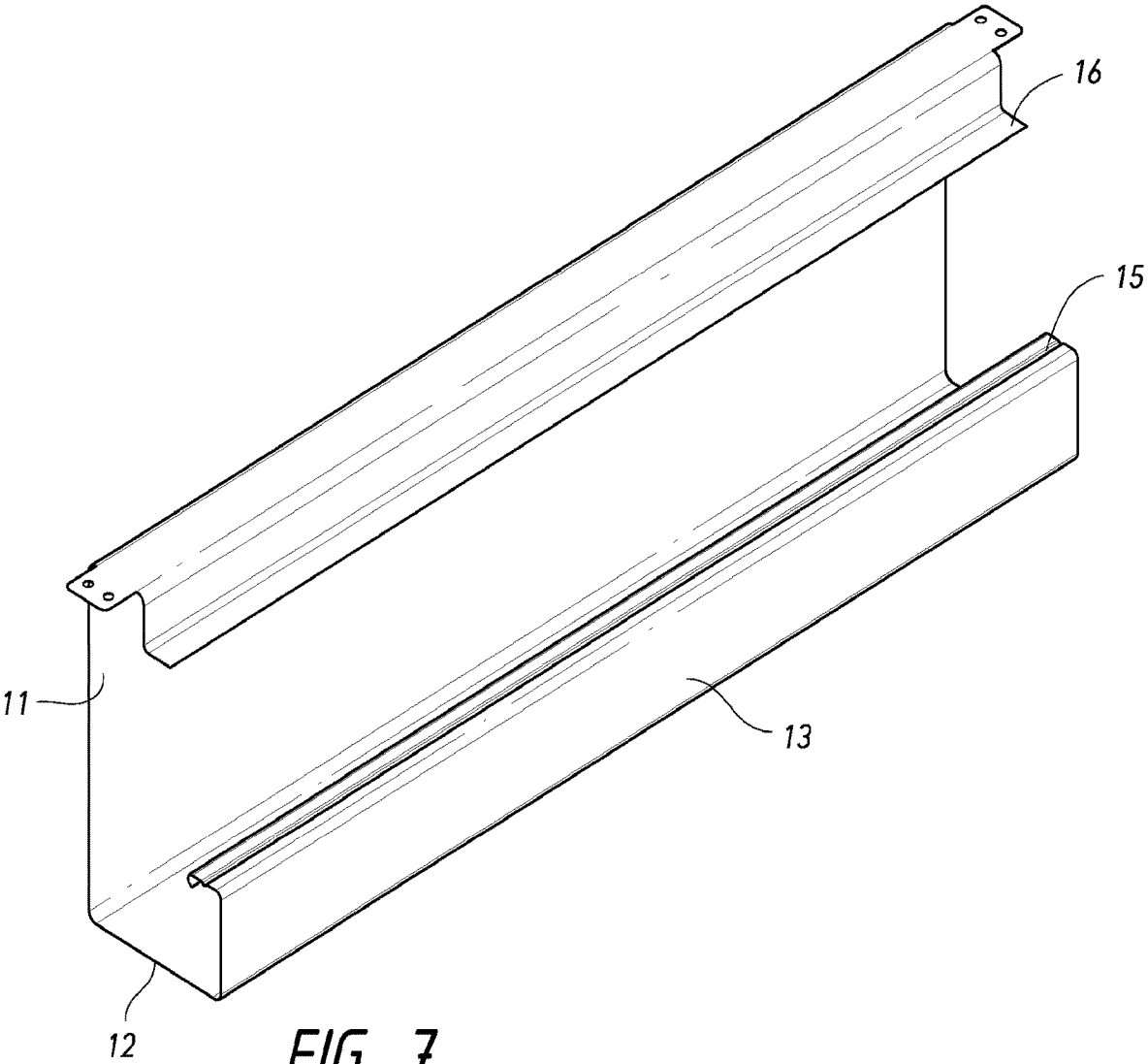
Figure 9:
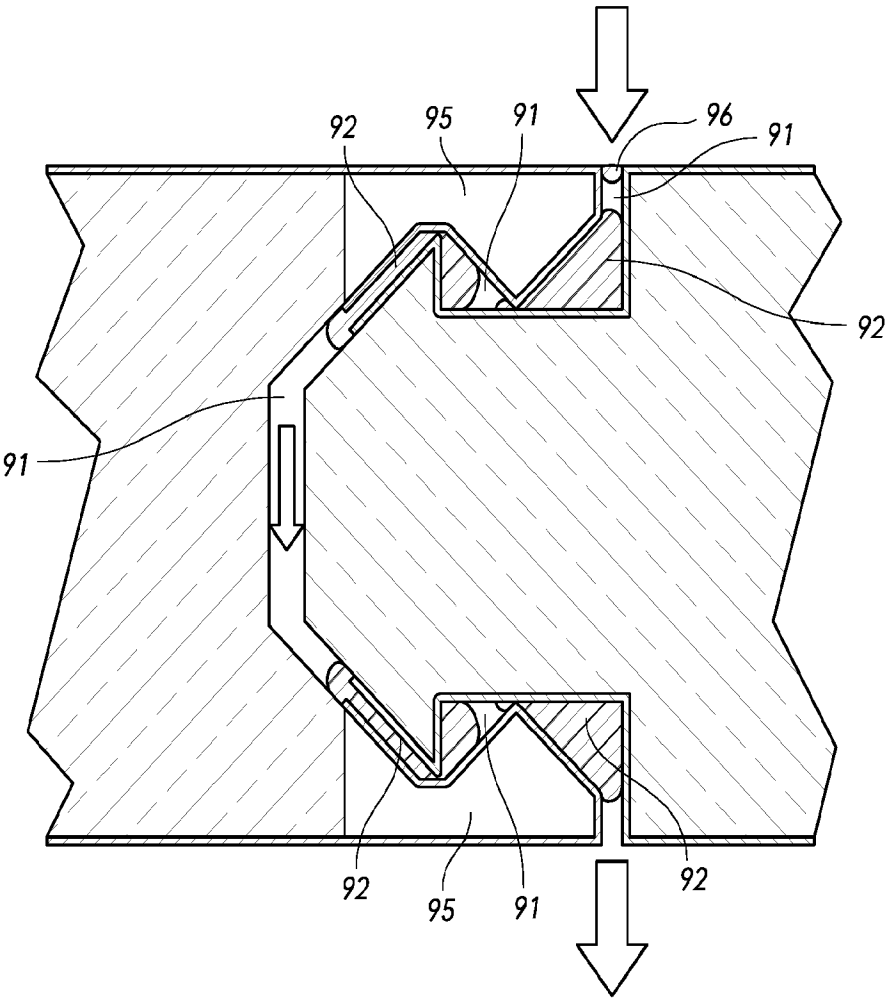
FIG. 9 (PRIOR ART)
FIGS. 9 and 10 shows joint assemblies according to the prior art and the progression of water, represented by the arrows, in the joint assemblies.

Referring to FIGS. 6 and 8, the fascia gutter 1 comprises a front member 11, a bottom member 12, a rear member 13, a ledge 14, a protrusion 16, and an opening 17, defined by the ledge 14 and the protrusion 16. The opening 17 is large enough to allow the panels 2 to be inserted and have a gap 7 between the panels 2 and the protrusion 16. The gap 7 allows for water that collects on the top surface of the panel to enter the fascia gutter 1. In some embodiments the gap 7 is ½ inch or greater. It is also understood that the gap 7 can be of any size. There is also a receiving gap 8 that exist between the panel 2 and the front member 11. The receiving gap 8 will allows the water that flows through the gap 7 to flow down into the receiving space. Some standard thicknesses for insulated panels 2 are 4 inches and 3 inches, and embodiments that can be used with those insulated panels 2 can have an opening 17 of 4½ and 3½ inches respectively.

Figure 11:
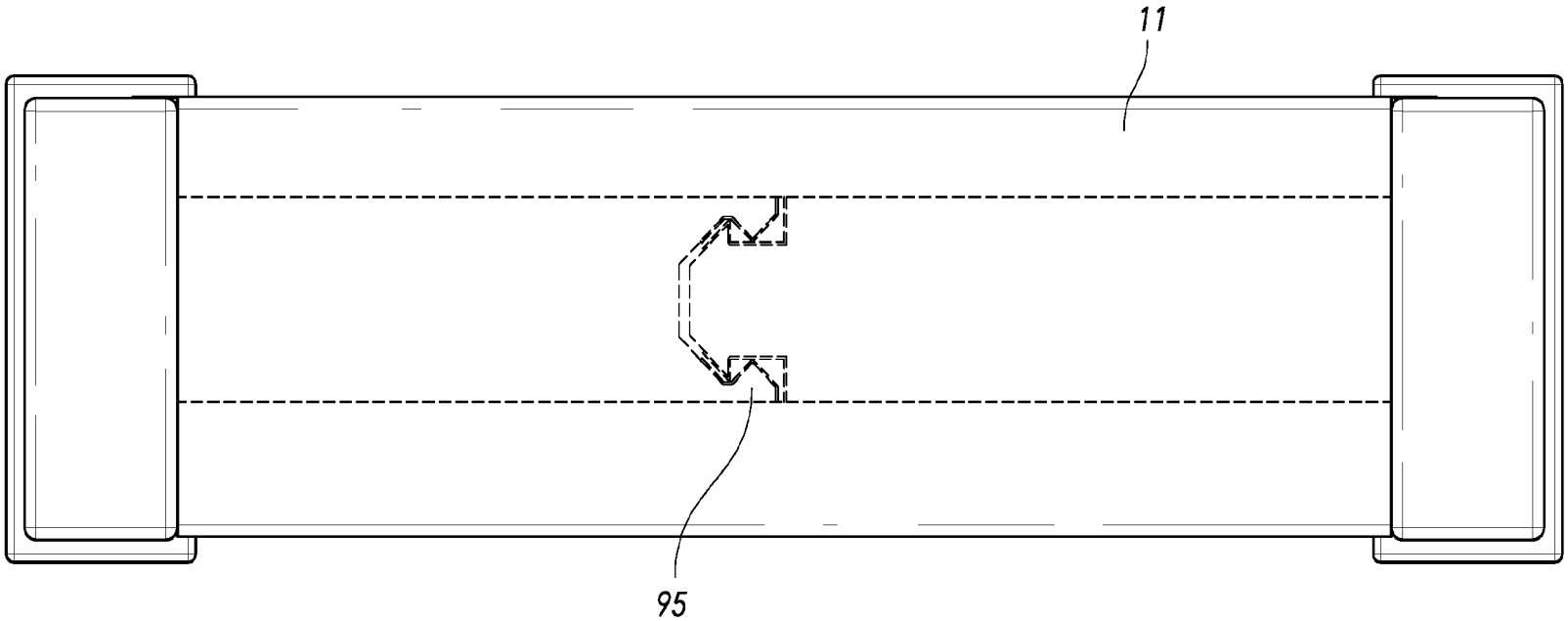
FIG. 11 is a front view of an embodiment of with an insulated panel and a joint.
Figure 12:
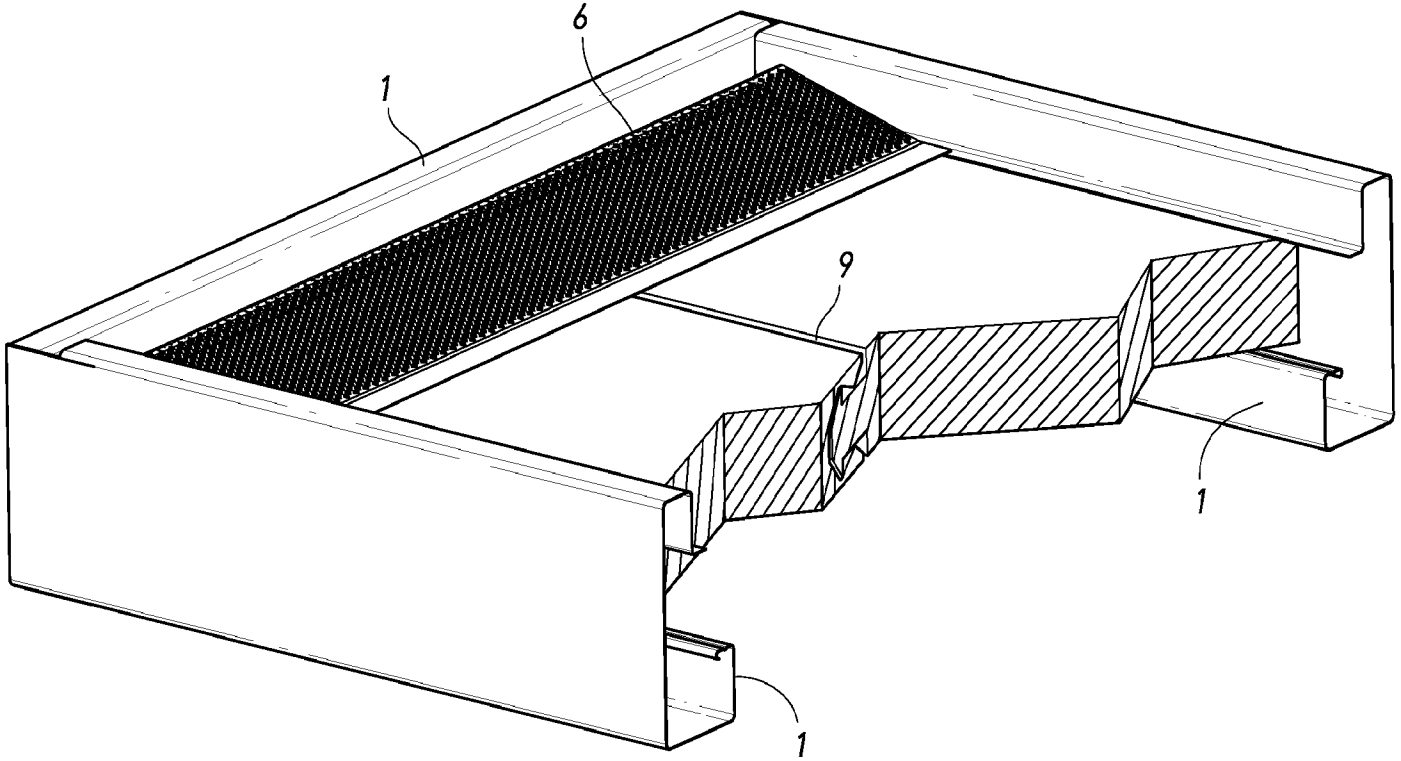
FIGS. 12 and 13 show an embodiment of a covering.

As can be seen in FIG. 11, in one embodiment, insulated panels 2 are employed. As seen from the front of the fascia gutter 1, the joint 9 is shown in shadow. By having the fascia gutter 1 running transverse to the joint 9 and open to the channels 91 and ducts 95, the entire joint 9 is in communication with the fascia gutter 1. Thus, just like the top of the panel, water present inside the joint 9/channels 91/ducts 95 will flow into the fascia gutter 1 and be removed from the joint 9 due to the slope of the covering. Water that happens to enter into anyone of the channels 91 and or ducts 95 is free to vacate into the fascia gutter 1. This will decrease the time that the internal seals 92 are exposed to the water and or water is present in the ducts 95. Thus having the joint 9 exposed to the opening 17, the fascia gutter 1 prevents or greatly reduces the standing water within the joint 9.

It is believed that less time the internal seals 92 are exposed to water and standing water, the longer they will maintain their integrity. The longer the integrity of the joint 9 is maintained, the longer the covering will last without maintenance. Additionally, the sooner water is evacuated from the duct 95; less water will accumulate and will not overflow through the bottom of the joint 9.

Also if any water happens to get into the body of the insulated panel, they are also open to the fascia gutter 1. In some embodiments, conduits (not shown) will be located in the insulated panels 2 (e.g. on the bottom of the insulation) to facilitate removal of water that happens to enter the insulated panels 2.

In some embodiments, the insulating material of the insulated panels 2 will include antibacterial, antimicrobial substances, and/or additives to help limit the growth of bacteria and/or microbes in and/or on the insulating material.

As can be seen in FIGS. 5-8, some embodiments of the fascia gutter 1 includes a guiding groove 15 located on the ledge 14. During construction, the builders typically are inserting the ledge fasteners 81, blindly through the panels 2. The guiding groove 15 helps guide the ledge fasteners 81 so that when they come into contact with the ledge 14, they are secured to the ledge 14. The width and shape of the guiding groove 15 is not limited (e.g. any concave shape). If the ledge fastener 81 misses the ledge 14, it will likely not be connecting the panels 2 to anything. In some embodiments, the protrusion 16 also has a guiding groove 15 (not shown).

The protrusion fastener 82 extends from above the protrusion 16 to the panels 2. However the gap 7 must be maintained. In some embodiments, it is incumbent upon the skill of the installer to maintain the gap 7. In other embodiments, a spacer (not shown) is located between the protrusion 16 and the panels 2. Examples of spacers include, but are not limited to, one or more nuts, one or more washers, and tubes. The spacer can be located only in the proximity of the protrusion fastener 82. Yet in other embodiments, a portion of the debris guard 6 can serve as a spacer (not shown). In some of those embodiments, the debris guard 6 can have a stepped configuration between the protrusion bend 63 and the end 62. The protrusion 16 will rest upon the step.

Figure 3:
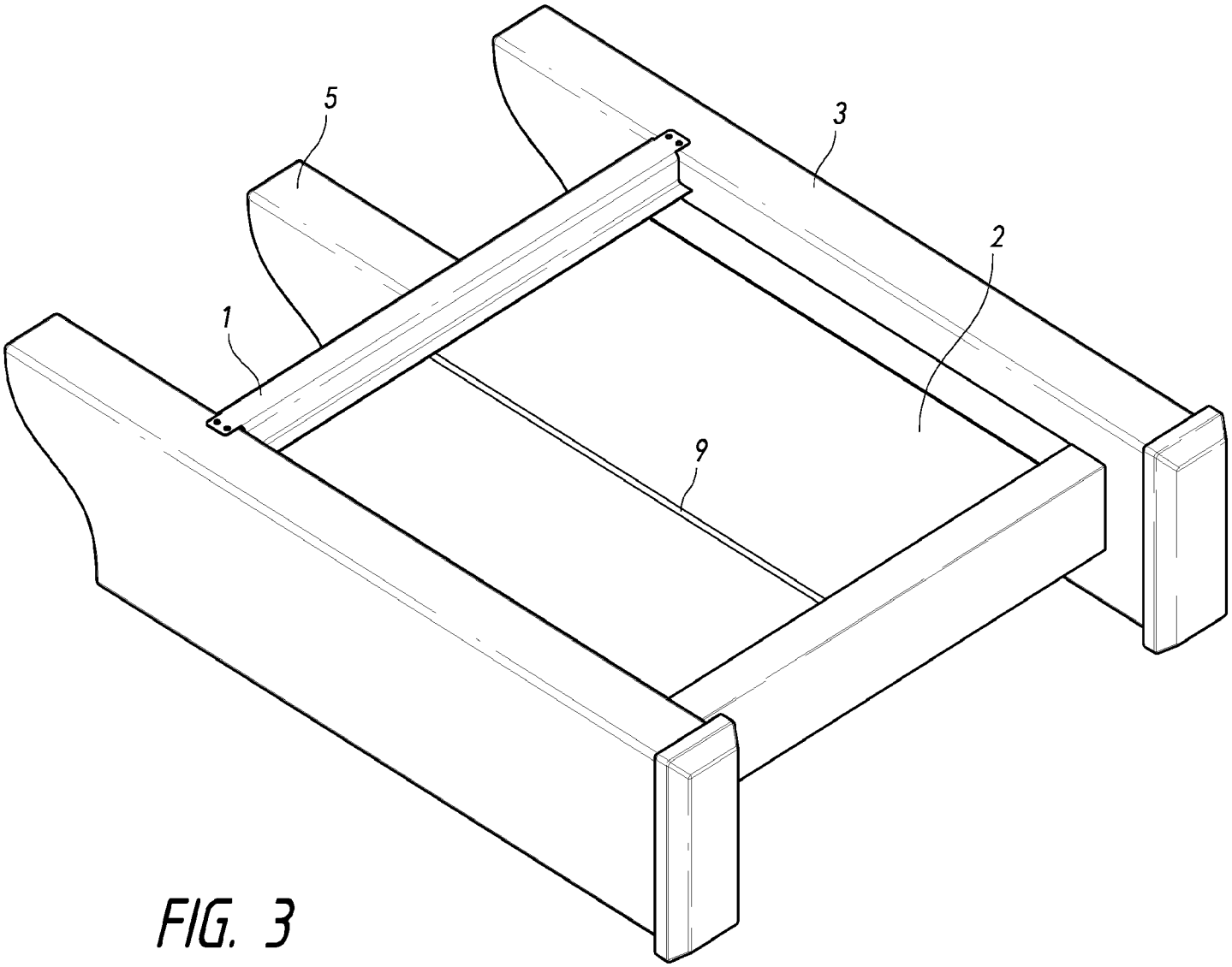
FIGS. 3 and 4 show embodiments of a covering employing a rafter tail.
Figure 4:
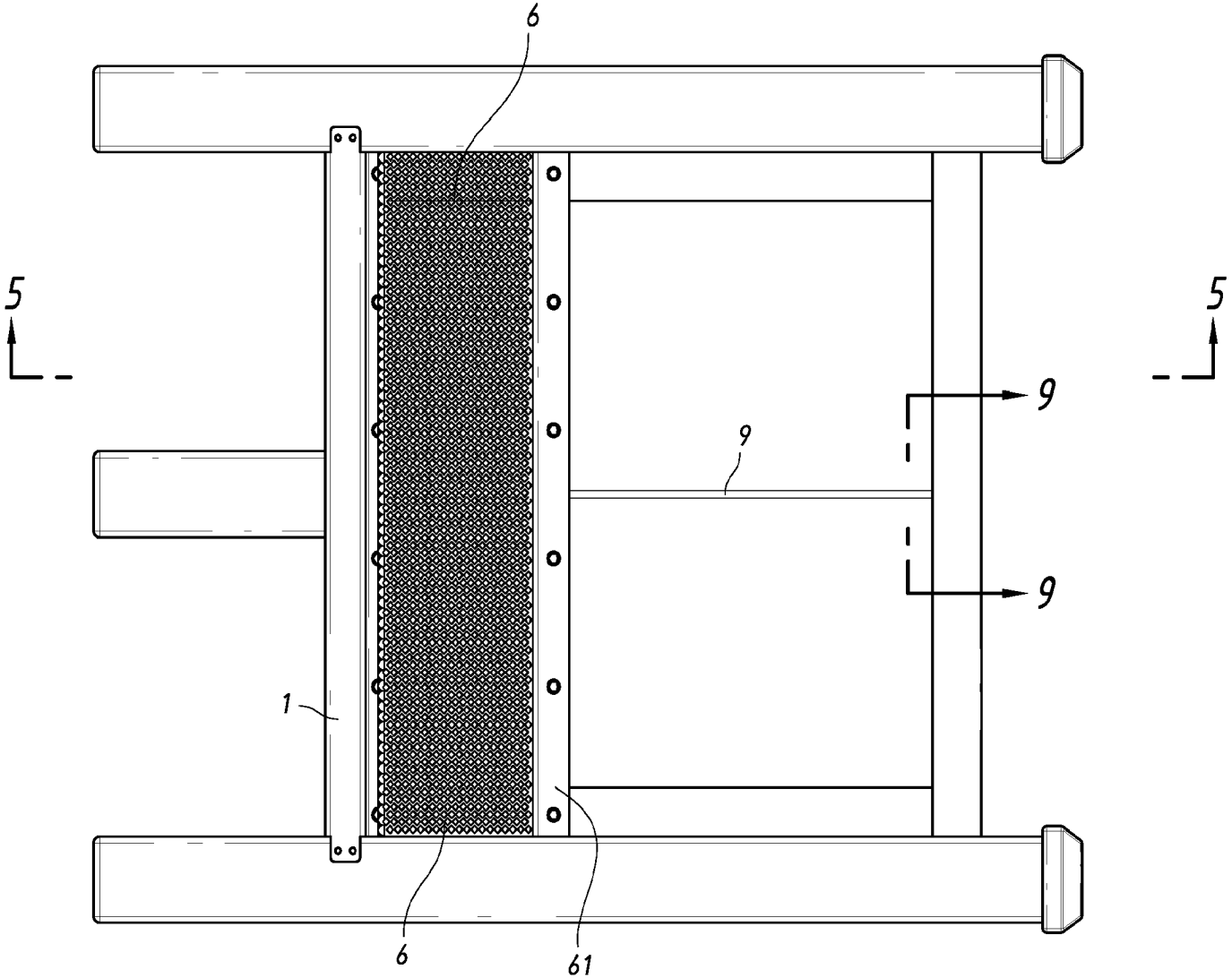
Figure 5:
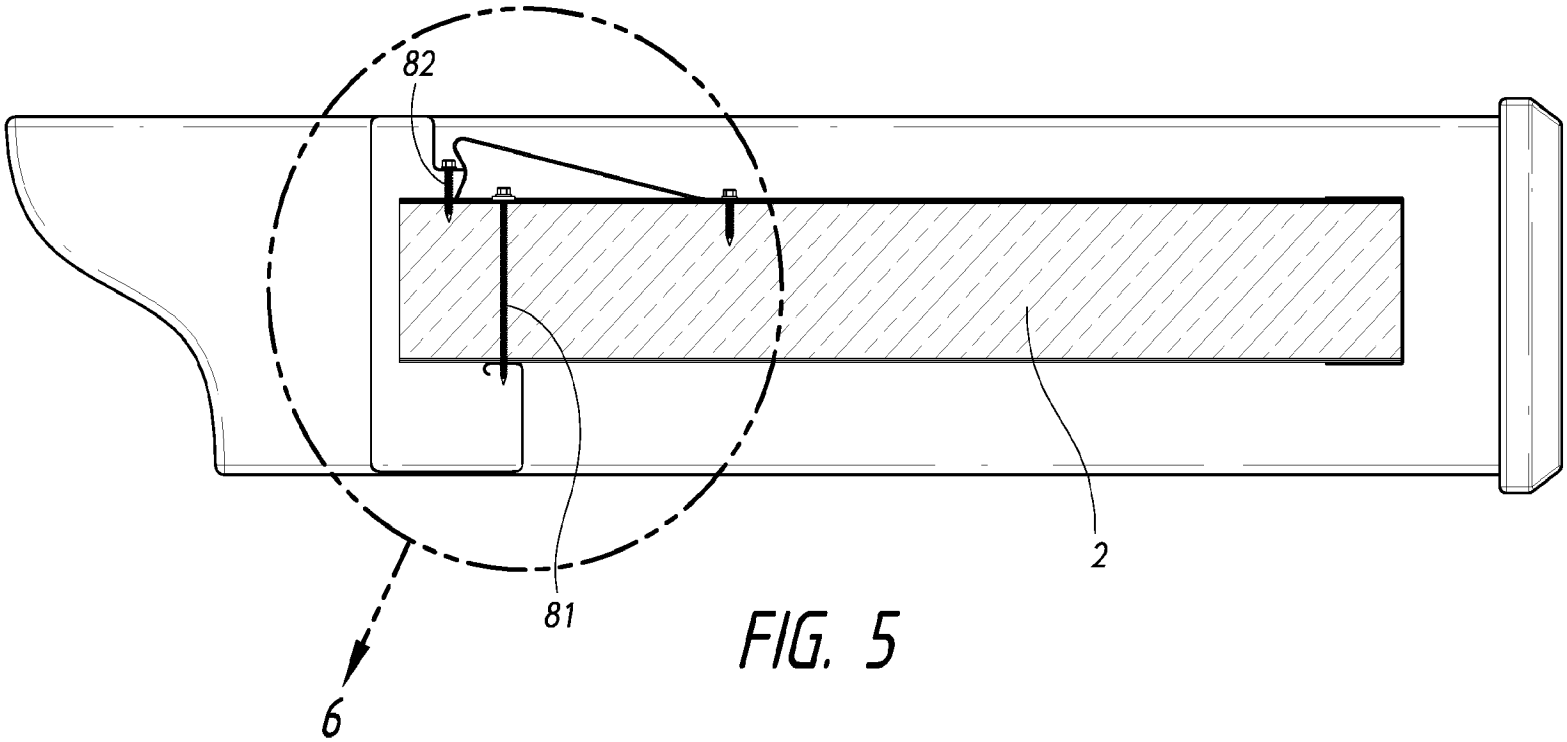
FIGS. 5 and 6 shows a cross-section of an embodiment.

Referring to FIGS. 3 and 4, some embodiments include a rafter tail 5 that can be attached to the fascia gutter 1 along the front member 11. In some embodiments the front member 11 is flat with an embossed finish, giving the appearance from the front of being a wood like structure. Then the rafter tail 5 can be installed to give the look from the front and below that a full rafter is employed. This will help maintain the natural look of the covering, e.g. a wood covering, while allowing for longer spans in between rafters 3. The location of the one or more rafter tails 5 can be set as desired. The rafter tails 5 can be attached by know methods including, but not limited to, one or more fasteners (not shown) and/or adhesives.

Figure 10:
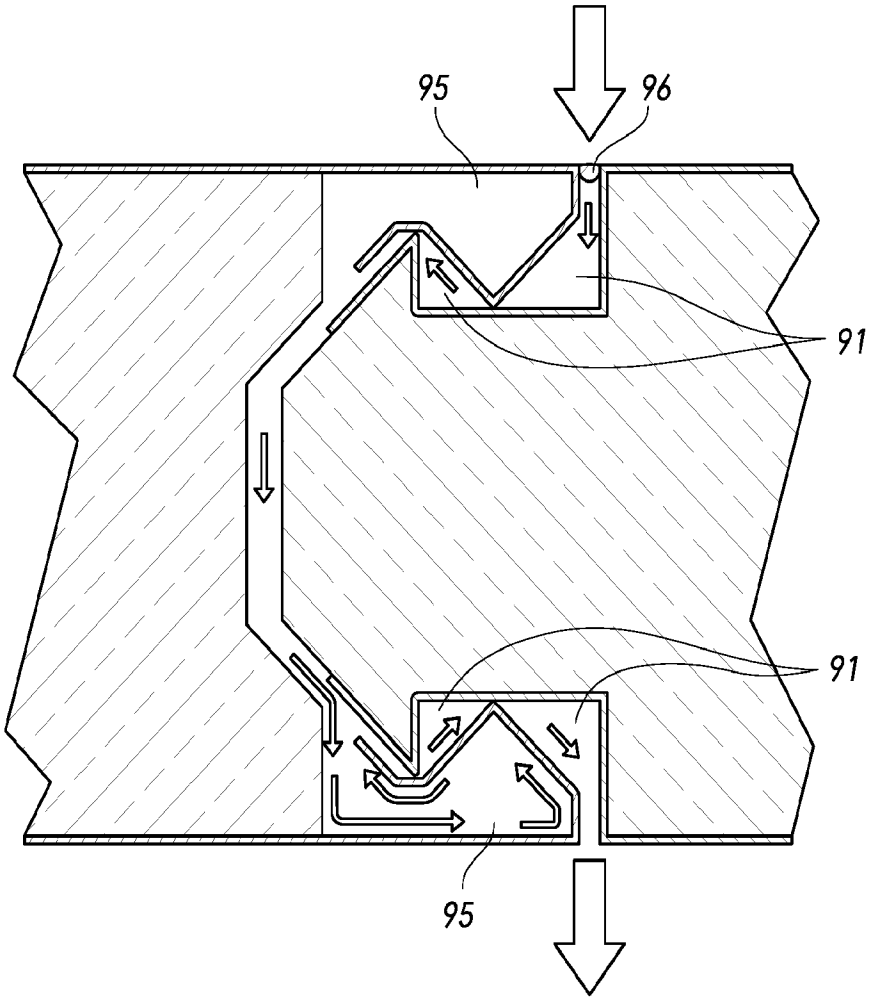
FIG. 10 (PRIOR ART)

As can be seen in FIGS. 10 and 11, additional fascia gutters 1 can run parallel to the joints 9 and can be, or not be, in communication with the fascia gutter 1 that runs transverse to the joints 9. While not shown, debris guard 6 can run along the length of the parallel fascia gutters 1 as they are able to accept water that has collected on the covering. This can increase the efficiency of evacuating water from the covering.

Figure 13:
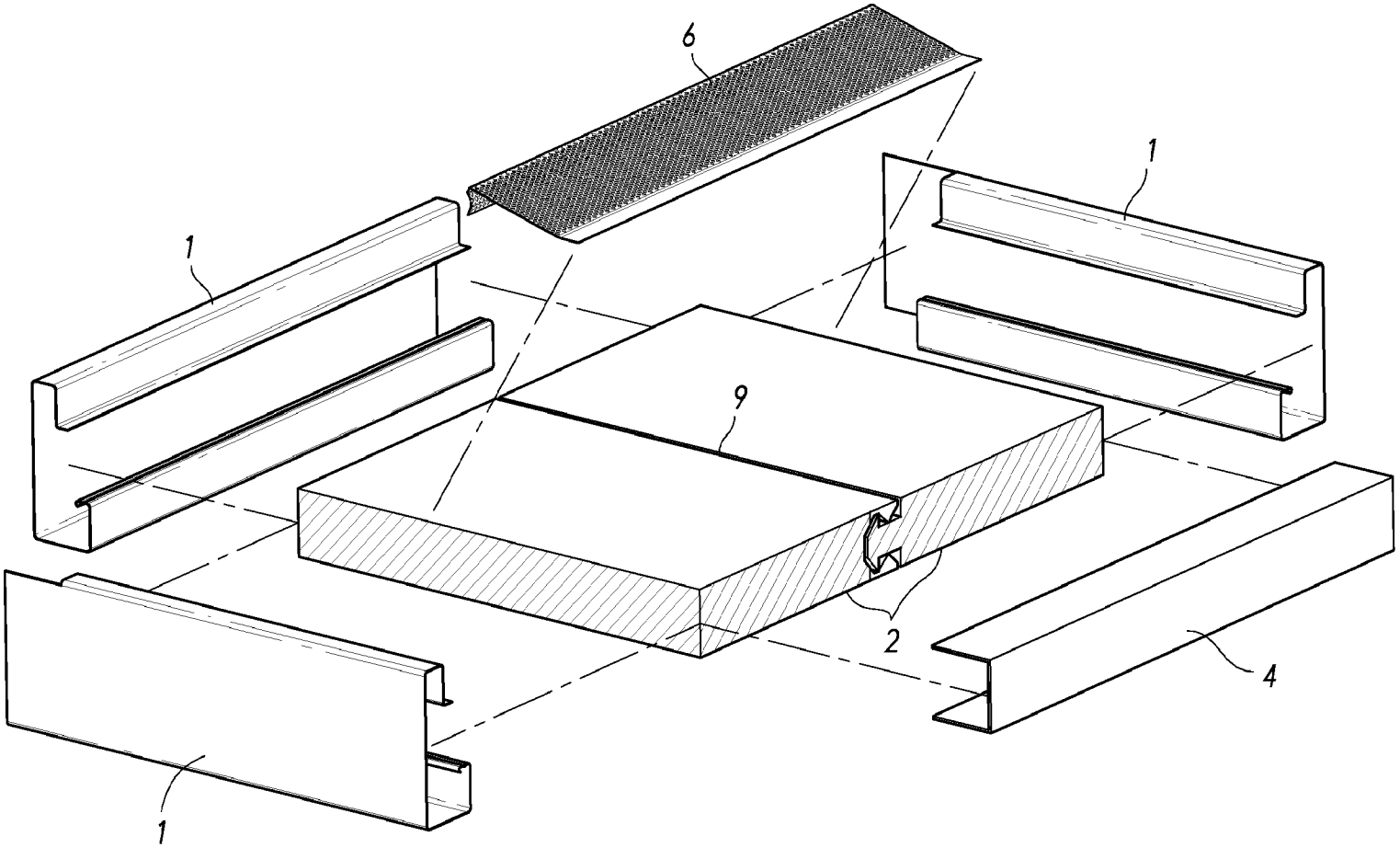

As can be seen in FIG. 13, some embodiments can include a structural member 100. The structural member 100 can be an insert that is separate from and has a shape that at least partially corresponds with the fascia gutter 1. In other embodiments, the structural member 100 is integral with the fascia gutter 1 or bonded thereto. The structural member 100 can be of the same material of the fascia gutter 1 or a different material than the fascia gutter 1. The structural member 100 can increase the strength of the fascia gutter 1. While a column can be attached to the fascia gutter 1 without a structural member 100, the span between columns can be increased when a structural member 100 is employed to the same fascia gutter 1. The thickness and material of the structural member 100 can be selected according to need.

Figure 14:
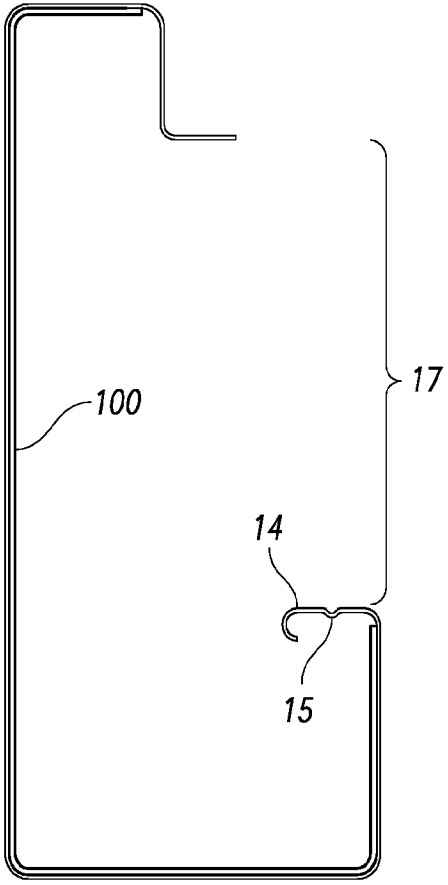
FIG. 14 shows an embodiment having structural member.
Figure 16:
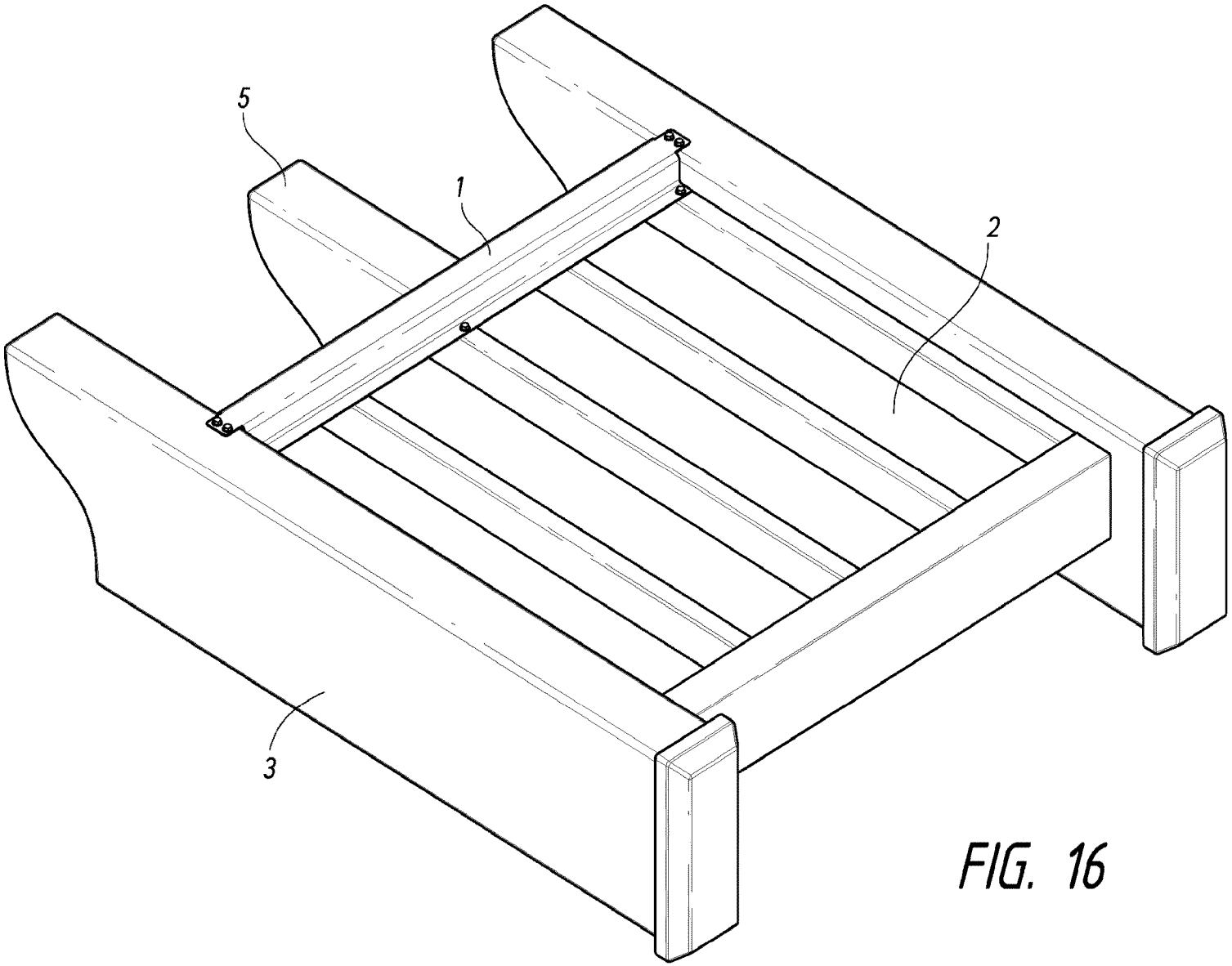
FIG. 16 shows an embodiment employing a flat pan and rafter tail.
Figure 17:
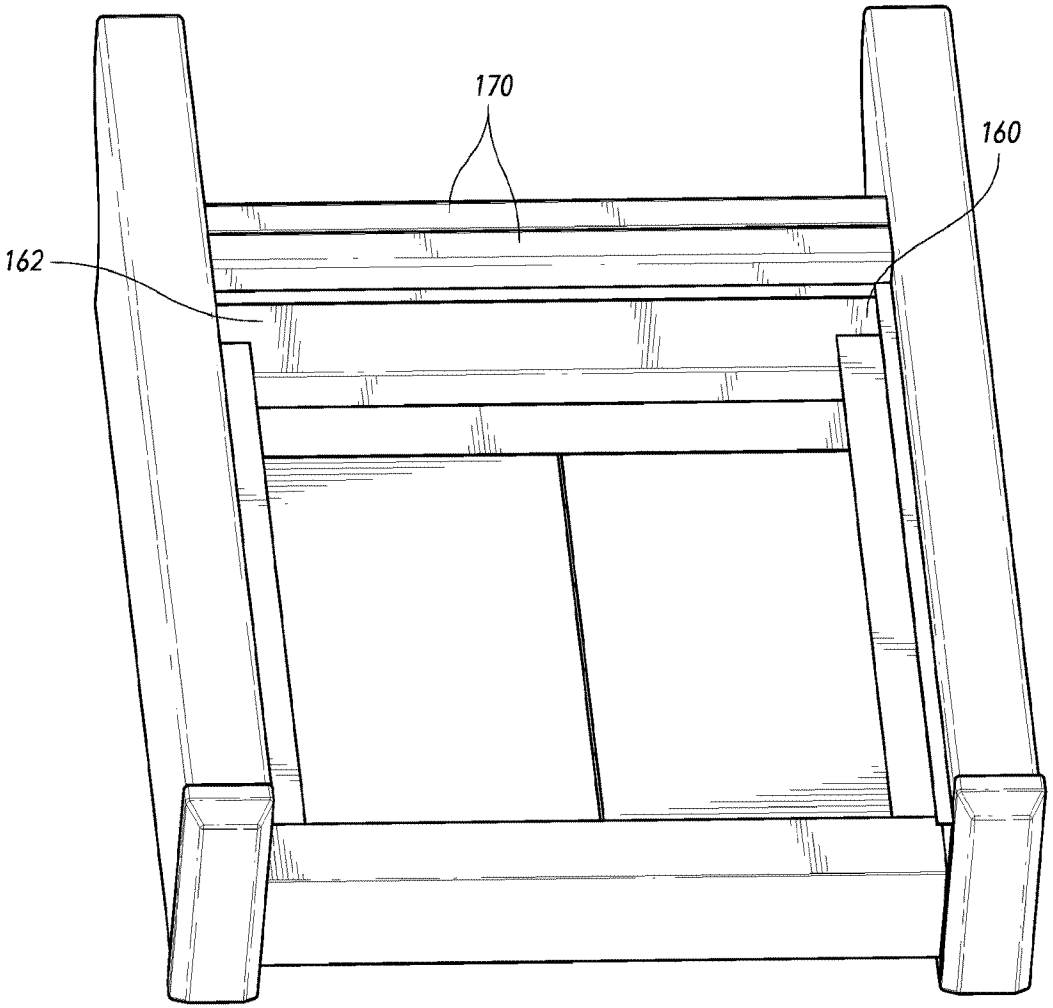
FIG. 17 (PRIOR ART)
FIGS. 17 and 18 show a covering according to the prior art.
Figure 18:
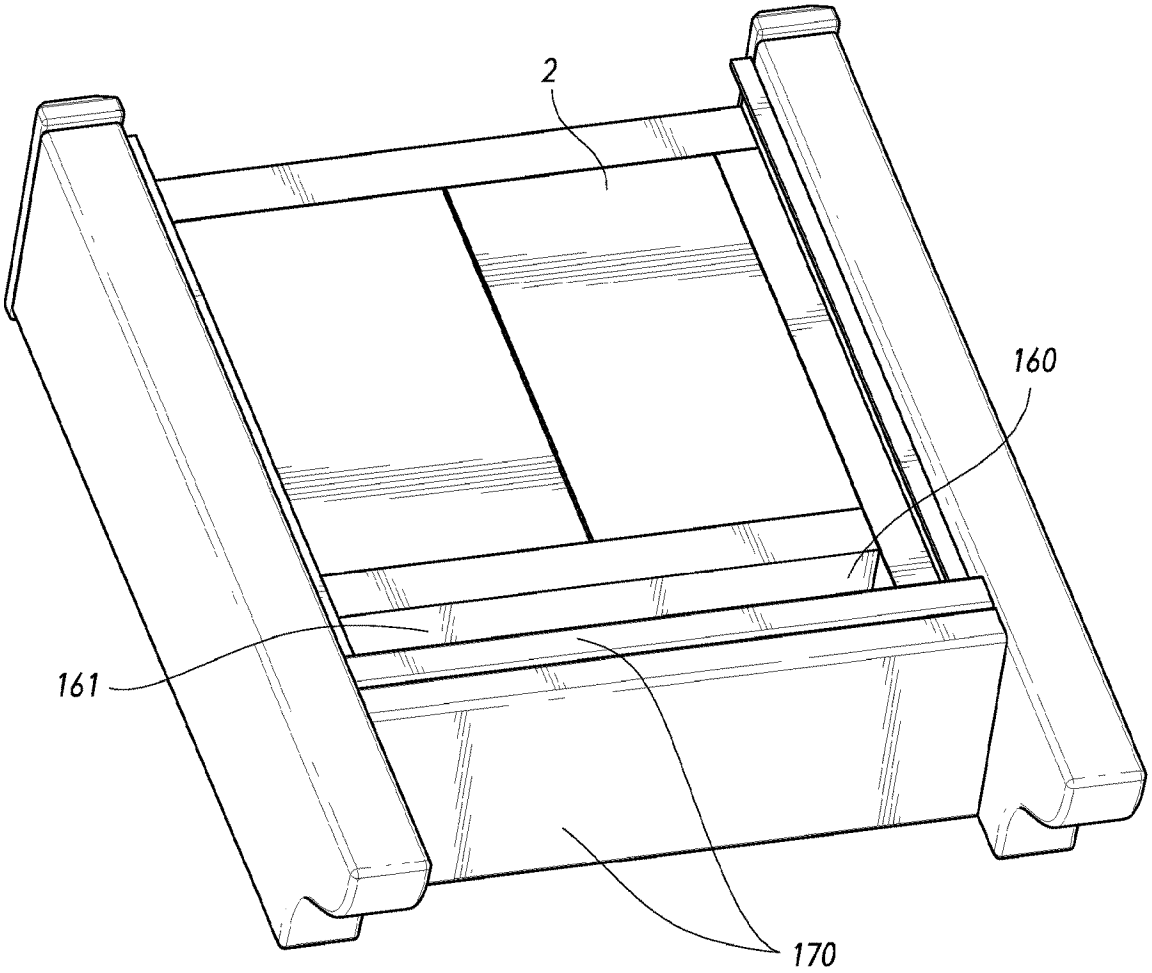
FIG. 18 (PRIOR ART)

As can be seen in FIG. 14, in one embodiment, a column attachment 110 can be connected to the fascia gutter 1 as a means to attach the fascia gutter 1 to a column. In some embodiments, the column attachment 110 is secured to the fascia gutter 1 by a fastener. In other embodiments, the column attachment 110 can be secured by an adhesive. Yet in other embodiments, the column attachment 110 is integral with the fascia gutter 1. The column attachment 110 has a shape that at least partially corresponds to the column and is able to slide therein. In some embodiments, the attachment is barely able to slide into the column and has a frictional fit with the column. In some embodiments, fasteners and/or adhesives can be used as well to secure the column attachment 110 to the column. The downward length of the column attachment 110 can vary. A greater length can increase the stability of the connection.

Figure 15:
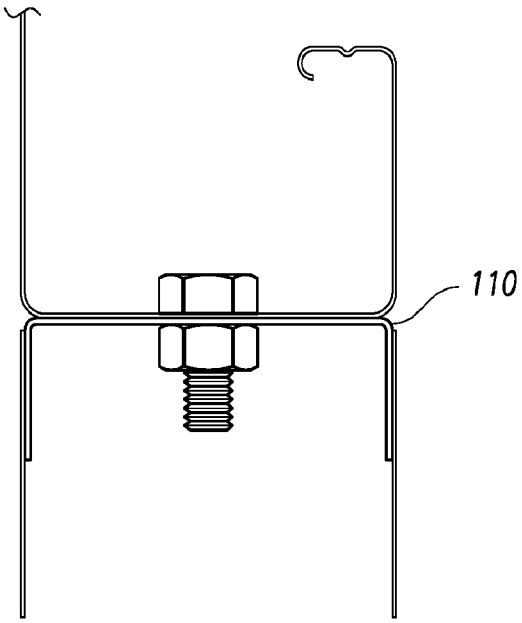
FIG. 15 shows an embodiment having a column attachment.

As seen in FIG. 15, the fascia can be used with a flat pan panel 2. When used with a flat pan panel 2 there need not be a gap 7. However a receiving gap 8 is still present. Thus the opening 17 can, but need not, correspond to the thickness of the flat pan panel 2. If the flat pan panel 2 is 4 inches in height, the opening 17 only needs to be 4 inches in height. Some embodiments the opening 17 will be slightly larger (e.g. 0.1 inches to 1 inch) than the height of the flat pan panel 2 to ease alignment during construction of the covering. One or more rafter tails 5 can be located on the front member 11. In other embodiments, a W-pan roof panels are used.

In some embodiments, the fascia gutter 1 is roll formed from aluminum sheets. In other embodiments, the fascia gutter 1 and the rafter tails 5 can have an embossed texture on the external faces thereof. In one embodiment, the front member 11 is 6.5 inches, the bottom member 12 is 3 inches, the rear member 13 is 2 inches, and the ledge 14 is 0.75 inches. In accommodating panels 2 of different thickness, the length of the front member 11 may, or may not, be altered, and the height of the protrusion 16 relative to the bottom member 12 may, or may, not be altered. The length of the front member 11 may remain consistent for panels 2 of different sizes, and other dimensions can be altered.

By using the fascia gutter 1 with insulated or flat pan panels 2, the use of a wrapping kit 170 is avoided. The use of the fascia gutter 1 in coverings enables one to retain all of the functionality of a wrapping kit 170 without the added weight and cost. The fascia gutter 1 also enables the columns to be placed further on the periphery of the covering. In embodiments employing a structural member 100, the spacing of the columns can be increased; while, in order to maintain the classic appearance of a wooden covering, rafter tails 5 can be applied directly to the fascia gutter 1. The structural member 100 can be made from extruded aluminum or galvanized steel.

Depending on the embodiment, certain steps or methods described may be removed, others may be added, and the sequence of steps may be altered. Those skilled in the art will now see that certain modifications can be made to the apparatus and methods herein disclosed with respect to the illustrated embodiments, without departing from the spirit of the instant invention. And while the invention has been described above with respect to several embodiments, any element and/or step described in reference to any particular embodiment is hereby disclosed to be associated with any other embodiment of the invention. It is understood that the invention is adapted to numerous rearrangements, modifications, and alterations, and all such arrangements, modifications, and alterations are intended to be within the scope of the invention.

The invention claimed is:

1. An apparatus comprising:

a fascia gutter, the fascia gutter comprises:
- a front member;
- a bottom member;
- a rear member;
- a ledge;
- a protrusion;
- a panel;
- a ledge fastener; and
- a protrusion fastener;

wherein the bottom member couples the front member to the rear member; the front member, the bottom member, and the rear member define a receiving space; the ledge is coupled to the rear member; an opening is defined by the ledge and the protrusion; a gap is defined by the panel and the protrusion; the protrusion fastener is coupled to the protrusion and the panel; and the ledge fastener is coupled to the ledge and the panel.

2. The apparatus of claim 1, wherein the panel is an insulated panel, the insulated panel comprises a channel, and the channel is in communication with the receiving space.

3. The apparatus of claim 2, further comprising a debris guard; wherein the debris guard abuts a bottom of the protrusion.

4. The apparatus of claim 1, further comprising a second panel; and the panel and the second panel form two interlocking panels, and the two interlocking panels are joined at a joint; the joint comprises a channel, and the channel is in communication with the receiving space; and the joint is in contact with the ledge and not in contact with the front member.

5. The apparatus of claim 4, wherein the joint further comprises an internal seal; the internal seal and the two interlocking panels define a duct; and the duct is in communication with the receiving space.

6. The apparatus of claim 1, further comprising a debris guard; wherein the debris guard abuts the protrusion.

7. The apparatus of claim 1, wherein the panel is a flat pan panel.

8. The apparatus of claim 1, further comprising a structural member; wherein the structural member has a shape that at least partially corresponds to the receiving space.

9. The apparatus of claim 1, further comprising a column attachment and a column; wherein the column attachment is secured to the bottom member and is in contact with the column.

10. The apparatus of claim 1, further comprising a rafter tail; wherein the rafter tail is secured to the front member.

11. The apparatus of claim 1, wherein at least a portion of the fascia gutter comprises an embossed finish.

12. The apparatus of claim 1, further comprising a groove, wherein the groove is defined in the ledge.

13. An apparatus comprising:

two interlocking panels, wherein the two interlocking panels define a plane; and a fascia gutter, the fascia gutter comprising:

a front member;

a bottom member;

a rear member;

a ledge; and a protrusion;

wherein the bottom member couples the front member to the rear member; the front member, the bottom member, and the rear member define a receiving space; the ledge is coupled to the rear member; an opening is defined by the ledge and the protrusion; the two interlocking panels are joined at a joint; the joint comprises a channel, and the channel is in communication with the receiving space; the joint is in contact with the ledge; and fluid is capable of flowing from the channel and into the receiving space.

14. The apparatus of claim 13, further comprising a groove, wherein the groove is defined in the ledge.

15. An apparatus comprising:

an insulated panel comprising a channel and an insulating material; and a fascia gutter, the fascia gutter comprising:

a front member;

a bottom member;

a rear member;

a ledge; and a protrusion;

wherein the bottom member couples the front member to the rear member; the front member, the bottom member, and the rear member define a receiving space; the ledge is coupled to the rear member; an opening is defined by the ledge and the protrusion; the channel is in communication with the receiving space; the insulated panel is in contact with the ledge; a gap is defined by the insulated panel and the protrusion; and fluid is capable of flowing through the gap and into the receiving space.

16. The apparatus of claim 15, further comprising a groove, wherein the groove is defined in the ledge.

17. The apparatus of claim 15, further comprising a second insulated panel and the insulated panel and the second insulated panel form two interlocking panels, and the two interlocking panels are joined at a joint; the joint comprises a channel, and the channel is in communication with the receiving space; and the two interlocking panels are in contact with the ledge and not in contact with the front member.

* * * * *